US005421113A

United States Patent [19]

Gebka et al.

[11] Patent Number: 5,421,113

[45] Date of Patent: Jun. 6, 1995

[54] INFORMATION DISPLAY TAG WITH EXTENDED LABEL HOLDER

[75] Inventors: John Gebka, Coral Springs; James M. Murray, North Lauderdale, both of Fla.

[73] Assignee: FEMC Ltd., Ft. Lauderdale, Fla.

[21] Appl. No.: 202,545

[22] Filed: Feb. 28, 1994

[51] Int. Cl.[6] ..... G09F 1/00

[52] U.S. Cl. ..... 40/642; 40/124.1

[58] Field of Search ..... 40/299, 124.1, 657; 248/220.4; 211/59.1

[56] References Cited

U.S. PATENT DOCUMENTS

| | | | |
|---|---|---|---|
| 4,140,224 | 2/1979 | Celeste | 40/642 X |
| 4,525,944 | 7/1985 | Fast | 40/124 |
| 4,646,454 | 3/1987 | Fast | 40/124.1 |
| 4,665,639 | 5/1987 | Fast | 40/124.4 |
| 4,693,024 | 9/1987 | Fast | 40/20 R |
| 4,698,929 | 10/1987 | Fast | 40/124.1 |
| 4,703,570 | 11/1987 | Fast | 40/19.5 |
| 4,715,135 | 12/1987 | Fast | 40/10 R |
| 4,850,557 | 7/1989 | Valiulis | 211/59.1 X |
| 5,261,175 | 11/1993 | Gebka | 40/299 |

FOREIGN PATENT DOCUMENTS

| | | | |
|---|---|---|---|
| 531034 | 3/1993 | European Pat. Off. | 40/657 |

*Primary Examiner*—Kenneth J. Dorner
*Assistant Examiner*—Cassandra Davis
*Attorney, Agent, or Firm*—Jacobson, Price, Holman & Stern

[57] ABSTRACT

A product information display tag for providing product information at the forward end of a horizontal product support hook has a mounting portion for attaching the tag to the rearward end of the hook, an elongate intermediate portion to extend over and along the hook and a label holder at the forward end of the intermediate portion. The mounting portion and intermediate portion are formed together as an integral plastic extrusion with a female grip at the forward end of the intermediate portion to attach the label holder. The label holder is formed as a coextrusion of a label holder panel in a rigid plastic material and a bead along one edge of the panel in a flexible plastic to fit in the grip at the forward end of the intermediate portion. The bead forms a hinge at the front end of the tag enabling the label holding panel to be raised and facilitate removal of articles from the hook.

11 Claims, 3 Drawing Sheets

INFORMATION DISPLAY TAG WITH EXTENDED LABEL HOLDER

BACKGROUND OF THE INVENTION

The invention relates to product identification and information tags for merchandise suspended from elongate horizontally oriented support hooks and the like. More particularly, the invention relates to such tags which may be readily attached to and removed from the support hooks without being subject to inadvertent removal, and which display product information forwardly of merchandise supported on a hook.

In recent years, there have been designed, for example, a number of elongate product information and identification tags, generally made of plastic sheet, for displaying the product information forwardly of items suspended from horizontal hooks which may extend, :for example, from apertured support boards and the like. Examples of such earlier tags may be found, for example, in prior U.S. Pat. Nos. 4,525,944; 4,646,454; 4,665,639; 4,693,024; 4,698,929; 4,703,570; 4,715,135 and 5,261,175.

Generally, tags of the above kind include a mounting portion for attachment to and removal from the hook at a location adjacent the proximal end of the hook, an elongate intermediate portion extending forwardly from the mounting portion along the length of the hook and the merchandise suspended therefrom, and a display portion at the distal end of the intermediate portion for the display of product information and the like.

As alluded to above, the known tags are generally made from plastic sheet, commonly by die-cutting or stamping the sheet to shape and providing therein various apertures and fold-lines needed to form the different portions of the tag. Inevitably, in such operations there is a degree of sheet wastage and somewhat complex stamping or pressing equipment is required.

SUMMARY OF THE INVENTION

It is an object of the invention to provide a different way of making information display tags of the kind referred to which, for example, provides economies in manufacture by substantially eliminating wastage of plastic and simplifying the equipment which can be used to make a range of products.

Another object of the invention is to provide an information display tag structure of the kind referred to which includes a living hinge between the intermediate portion and display portion of the tag enabling the display portion to be lifted upwardly and away from a hook on which the tag is mounted so as to facilitate removal of products suspended on the hook.

Generally stated the invention provides a plastic information display tag of the kind referred to wherein at least the mounting portion and intermediate portion of the tag are formed from an integral plastic extrusion produced through a die having a profile corresponding to the lengthwise profile of the two portions of the tag in the ready-to-use form. Thus, generally the extrusion will have the mounting portion formed as a downwardly extending leg at one end of the profile. The extrusion may also include an integral downwardly extending leg at the other end of the profile to form the display portion of the tag. In a preferred embodiment, however, the extrusion terminates in a grip at the distal end of the intermediate portion to receive a separate display portion which may comprise a label holder in the form of a co-extrusion comprising a body panel of a relatively hard or rigid plastic material for receiving a label and a bead portion of a relatively soft or flexible plastic material for receipt in the grip and for providing a living hinge between the intermediate portion and the body panel.

To produce a tag, the extrudate is simply cut to the required width in each case and cut-outs or other formations may be made on the mounting portion as required. The width of the label holder may be the same as or different from that of the remainder of the tag and different size label holders can be provided to go with a particular tag to suit different size labels. Also, it is evident that different shape mounting portions can be provided to suit different applications.

The invention thus provides a simple and economical way of producing tags which are well suited to meeting the inventive objects. Additional features and advantages of the invention will become apparent from the following description and claims read in conjunction with the attached drawings.

DESCRIPTION OF PREFERRED EMBODIMENT

Figure 1:
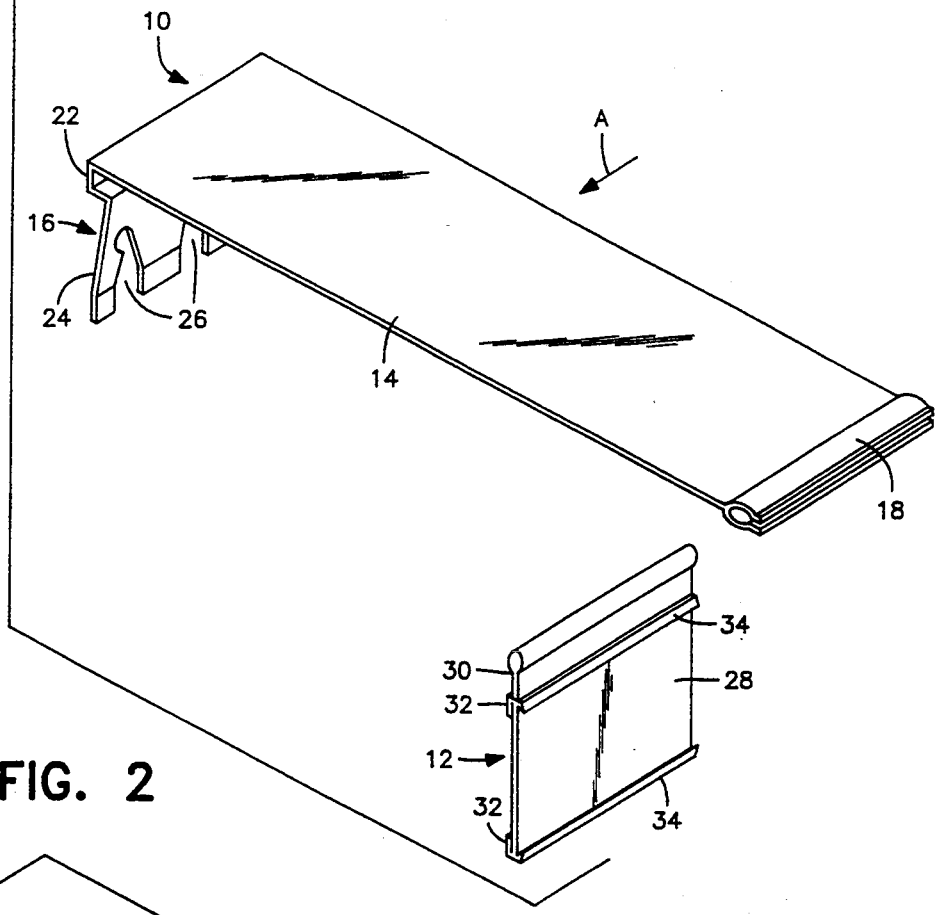
FIG. 1 is an exploded perspective view of a two-part information display tag according to the invention.

Referring firstly to FIG. 1 there are illustrated two parts 10 and 12 which fit together, as will be described to form a product information and display tag.

Part 10 of the tag is cut from a plastic extrudate which has been extruded through a suitable die in the direction of arrow A so that part 10 of the tag includes an elongate portion 14 (which in use is the intermediate portion of the tag) and a mounting portion 16 in the form of a leg depending from one end, the proximal end, of the elongate portion. At its opposite end, the distal end, the elongate portion is formed with a bifurcated grip 18 for receipt of the second part 12 of the tag. Part 10 of the tag is made of a relatively hard or rigid polyvinylchloride for example.

Figure 4:
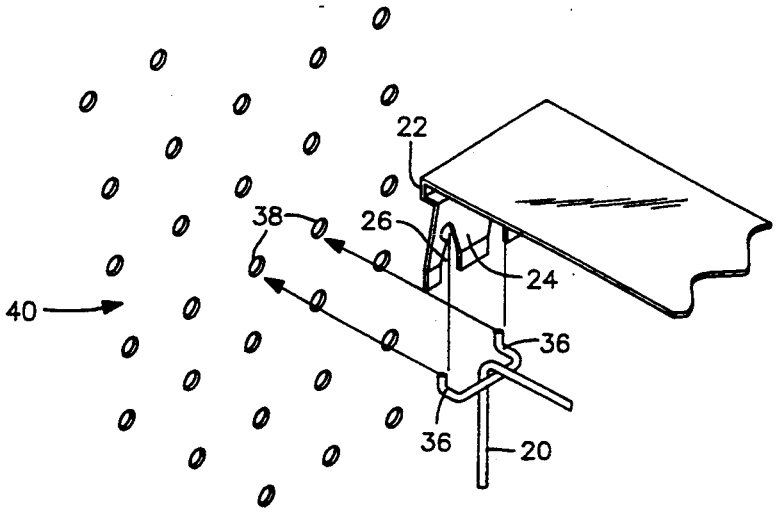
FIG. 4 is an exploded perspective view of a back or proximal end portion of the tag showing how it can be attached to a product support hook.
Figure 5:
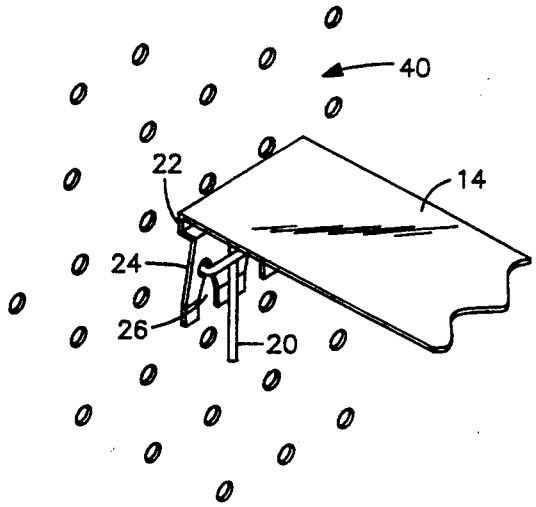
FIG. 5 is a view similar to FIG. 4 showing the back end of the tag attached to the hook.
Figure 6:
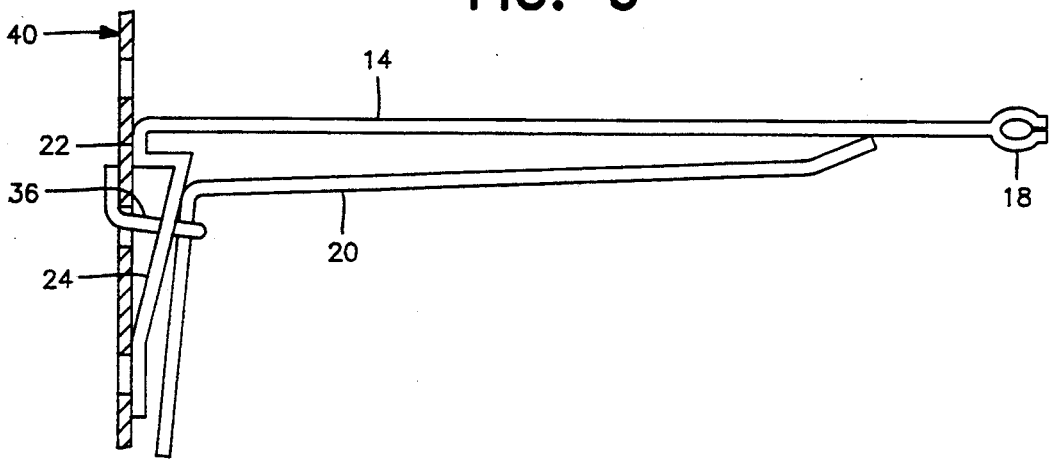
FIG. 6 is a side elevational view of the tag and hook assembly.

The mounting portion 16, in the embodiment illustrated is formed as a half-wedge for use on a two-prong wire-back hook 20 as shown in FIGS. 4 to 6. For this purpose, the mounting portion has a channel-shaped top 22 from which depends an inclined panel 24 in which two key-hole shaped notches 26 are formed after extrusion. For other applications, however, the mounting portion can be differently configured.

Figure 2:
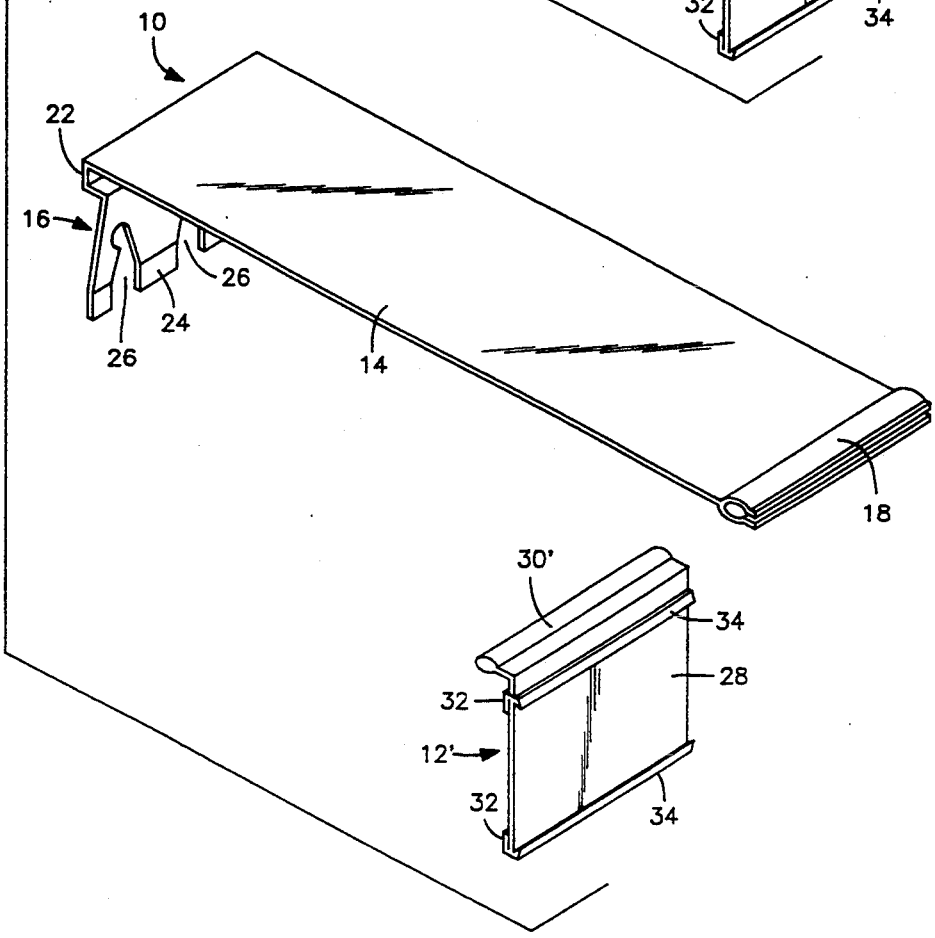
FIG. 2 is a view similar to FIG. 1 showing a modification.

Part 12 of the tag comprises a label holder having a channel shaped main body panel 28 of a relatively hard or rigid polyvinyl chloride or other plastic similar to part 10 and a coextruded bead 30 along the top edge of the body panel for receipt in grip 18, and which is formed of a relatively soft or flexible polyvinyl chloride or other plastic, for example. FIG. 2 shows a similar label holder part 12' wherein bead 30' has a turned-over shape. In either case, the respective bead 30, 30' can be snapped or slid into grip 18 to connect the two parts of the tag and the bead being of soft flexible plastic forms a hinge between the two parts so that, in use, the label holder part 12 can be lifted relative to the part 10 as shown by arrow 13 in FIG. 3.

Part 10 of the tag as well as panel 28 may, for example, each be extruded from any conventional PVC referred to commercially as "rigid" such as Occidental Chemical Corporation's OXYCLEAR 161J/161J-1 or Georgia Gulf's Extrusion Compound 8247 or 7020. The bead 30 or 30' may be co-extruded from a "flexible" PVC such as Teknor Apex Company's 3165 Compound or Synergistics' Clear Compound 0750. Of course, these commercially available PVC extrusion compounds are identified as illustrative. Further, while PVC is the material of choice for both the rigid and flexible portions of the tag, those skilled in the art can readily substitute alternative rigid and flexible polymers therefor without departing from the instant inventive concepts.

Figure 3:
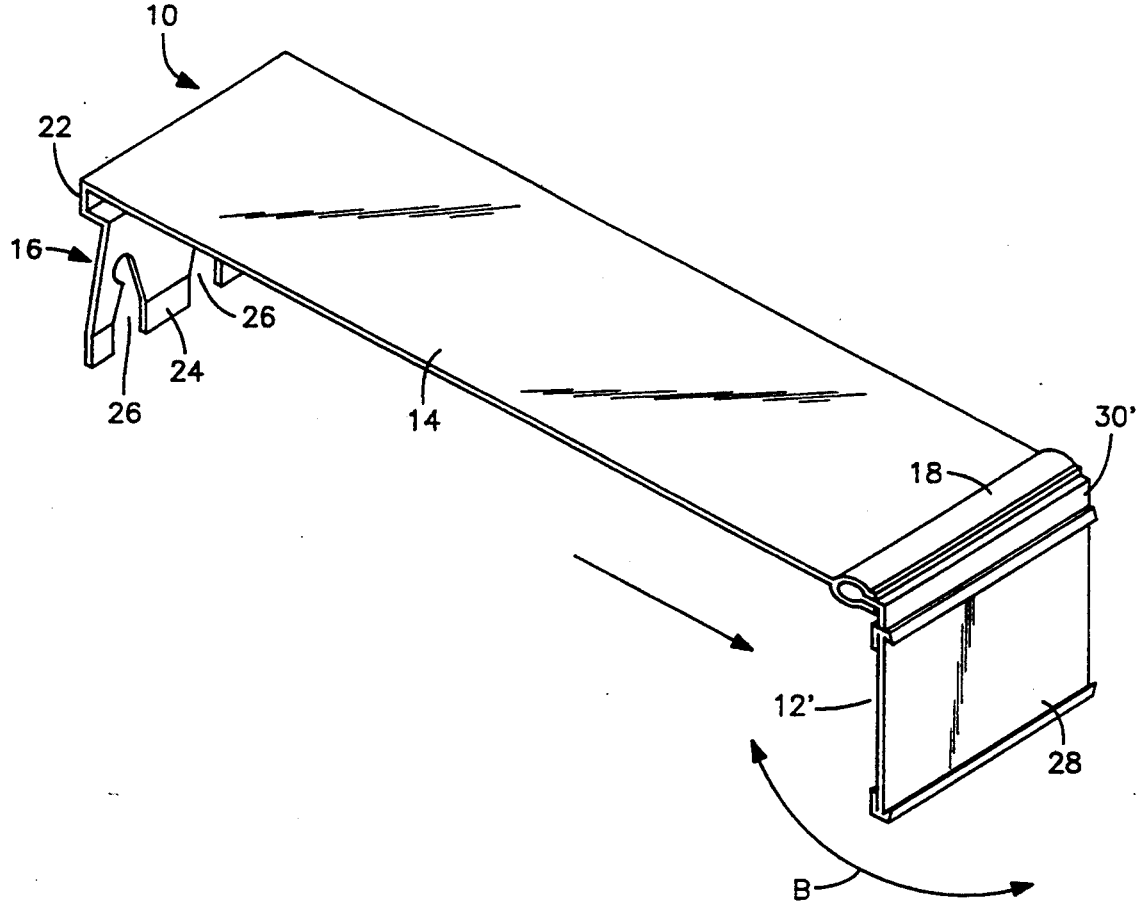
FIG. 3 is a perspective assembled view of the tag.

In FIGS. 1 to 3, label holder part 12 is shown as being the same width as part 10 but part 12 could also be cut to a different width to suit a different size label. The body panel 28 may have rear limbs 32 and/or front lips 34 so that a non-adhesive label can be inserted in front of or behind the label holder. For adhesive labels, however, a plane body panel can be used.

In use, the tag attaches to a wire hook 20 in the manner shown in FIGS. 4–6. Thus, the hook has twin prongs 36 at the proximal end which fit in respective apertures 38 of an apertured board 40. The apertures 26 in mounting portion 16 of the tag fit down over the prongs 36 and the half-wedged shape of the mounting portion with channel 22 and inclined panel 24 causes the mounting portion to be firmly wedged between board 40 and the back of hook 20, as best seen in FIG. 6. The label holder part 12 of the tag can be inserted into and removed from grip 18 when part 10 of the tag is attached to the hook or prior to such attachment.

While only a preferred embodiment of the invention has been described herein in detail, the invention is not limited thereby and modifications can be made within the scope of the attached claims. For example, the tag may comprise an integral 3-part extrusion with a hinge section of relatively flexible plastic between and intermediate portion and label-holding portion which are each of a more rigid plastic.

We claim:

1. An elongate plastic information display tag for presenting product information at a forward end of a substantially horizontal product support hook, the tag comprising a mounting portion at one end of the tag for attachment to a rearward end of the hook, an elongate intermediate portion adjacent the mounting portion to extend over and along the hook and a product information display portion at a forward end of the tag wherein the mounting portion, the intermediate portion and the display portion each comprise a first relatively rigid plastic material and wherein the tag includes a hinge means including a part which is of a second relatively flexible plastic material different from the first plastic material between the intermediate portion and the display portion for permitting upward hinging motion of the display portion when the tag is attached to the hook.

2. The invention as defined in claim 1 including releasable attachment means between the intermediate portion and the display portion wherein the hinge means is included in said attachment means.

3. The invention as defined in claim 2, wherein said intermediate portion and said mounting portion together comprise an integrally extruded part of the tag, said mounting portion comprising a downwardly depending leg at a rearward end of the intermediate portion.

4. The invention as defined in claim 3, wherein the mounting portion is formed as a half-wedge having a channel section at a junction with the intermediate portion, an inclined panel extending downwardly from the channel section and cut-outs in the panel to fit over a pair of prongs at the rearward end of the hook.

5. An elongate plastic information display tag for presenting product information at a forward end of a substantially horizontal product support hook, the tag comprising a mounting portion at one end of the tag for attachment to a rearward end of the hook, an elongate intermediate portion adjacent the mounting portion to extend over and along the hook and a product information display portion at a forward end of the tag wherein the mounting portion, the intermediate portion and the display portion each comprise a relatively rigid plastic material and wherein the tag includes a hinge means of a relatively flexible plastic material between the intermediate portion and the display portion for permitting upward hinging motion of the display portion when the tag is attached to the hook, wherein the attachment means comprises a female grip on the intermediate portion and a male bead on the display portion to fit in said grip, said grip and said bead in combination forming the hinge means.

6. The invention as defined in claim 5 wherein the display portion comprises a label holding panel of said relatively rigid material coextruded with said bead of said relatively flexible material.

7. A plastic information display tag for presenting product information at a forward end of a substantially horizontal product support hook, the tag comprising a first extruded part and a second extruded part, the first extruded part including a mounting portion for attaching the tag to a rearward end of the hook and an elongate intermediate portion extending from the mounting portion to project over and along the hook, the mounting portion being in the form of a leg depending from one end of the intermediate portion and an opposite end of the intermediate portion being formed with a first attachment means, the second extruded part comprising an information display portion of the tag including a label holding panel and a second attachment means for attachment to said first attachment means with the label holding panel extending downwardly from said opposite end of the intermediate portion, wherein one of the first and second attachment means comprises a plastic material which is relatively more flexible than a material used for the other of the attachment means to form a hinge means between the first and second extruded parts permitting hinging motion of the label holding panel relative to the intermediate portion of the tag.

8. The invention as defined in claim 7, wherein the first attachment means comprises a female grip at said opposite end of the intermediate portion of the tag and the second attachment means comprises a bead of said relatively more flexible material coextruded with said label holding panel.

9. A two-part plastic information display tag for presenting product information at a forward end of a substantially horizontal product support hook, the tag comprising a first elongate part having a mounting portion at one end for attaching the tag to a rearward end of the hook, an elongate portion extending from the mounting portion to project over and along the hook and a female grip at a second opposite end, the tag further comprising a second part having a label-holding panel and a flexible bead along one edge of the label holding panel for fitting in said grip and forming a hinge means between the first and second parts of the tag with the label holding panel extending downwardly at said second end of the first part.

10. The invention as defined in claim 9, wherein said first part of the tag comprises an extrusion having the mounting portion in the form of a depending leg at said one end and wherein said second part of the tag comprises a coextrusion of said label holding panel in a relatively rigid plastic material and said bead in a relatively flexible plastic material.

11. The invention as defined in claim 10, wherein the mounting portion is in the form of a half-wedge with a channel section forming a junction with said elongate portion of the tag and an inclined panel depending from said channel section and wherein the inclined panel includes a pair of cut-outs for fitting on a pair of prongs at the rearward end of the hook.

* * * * *